US009970286B2

(12) United States Patent
Godager

(10) Patent No.: US 9,970,286 B2
(45) Date of Patent: May 15, 2018

(54) METHOD AND APPARATUS FOR PERMANENT MEASUREMENT OF WELLBORE FORMATION PRESSURE FROM AN IN-SITU CEMENTED LOCATION

(71) Applicant: SENSOR DEVELOPMENTS AS, Sandefjord (NO)

(72) Inventor: Øivind Godager, Sandefjord (NO)

(73) Assignee: SENSOR DEVELOPMENTS AS, Sandefjord (NO)

( * ) Notice: Subject to any disclaimer, the term of this patent is extended or adjusted under 35 U.S.C. 154(b) by 531 days.

(21) Appl. No.: 14/592,604

(22) Filed: Jan. 8, 2015

(65) Prior Publication Data

US 2016/0201451 A1 Jul. 14, 2016

(51) Int. Cl.
*E21B 47/06* (2012.01)
*E21B 49/08* (2006.01)

(52) U.S. Cl.
CPC ..... *E21B 47/06* (2013.01); *E21B 49/08* (2013.01); *E21B 49/087* (2013.01)

(58) Field of Classification Search
None
See application file for complete search history.

(56) References Cited

U.S. PATENT DOCUMENTS 4,161,782 A 7/1979 Mccracken
4,453,401 A 6/1984 Sidey
4,553,428 A * 11/1985 Upchurch ..... E21B 34/10 175/48
4,662,442 A * 5/1987 Debreuille ..... E21B 33/14 166/250.01
5,467,823 A 11/1995 Babour et al.
6,029,524 A 2/2000 Klauder et al.
6,125,935 A 10/2000 Shahin, Jr.
6,279,392 B1 8/2001 Shahin, Jr. et al.
(Continued)

FOREIGN PATENT DOCUMENTS

EP 2389498 A1 11/2011
WO 2007056121 5/2007
WO 2012073145 6/2012
WO 2013052996 4/2013

OTHER PUBLICATIONS

Choi, et al., "A Novel Direct Measurement of Formation Pore Pressure," 48th U.S. Rock Mechanics/Geomechanics Symposium, Jun. 1-4, 2014, Minneapolis, Minnesota.
(Continued)

*Primary Examiner* — Jill Culler
(74) *Attorney, Agent, or Firm* — Haynes and Boone, LLP

(57) ABSTRACT

A pressure gauge system and a method for in-situ determination of a wellbore formation pressure through a layer of cement, comprising; a housing arranged to be permanently installed in said cement on the outside of a wellbore casing, comprising; a pressure transfer means between a first oil filled chamber and a pressure sensor, to isolate said pressure sensor from said oil filled chamber, and a pressure permeable filter port in hydrostatic connectivity with said first oil filled chamber, and a porous string extending from said filter port, said string has a higher porosity and a higher hydrostatic connectivity than said cement for said formation fluid, and is arranged to transfer said formation fluid when it is embedded in said cement.

12 Claims, 8 Drawing Sheets

(56) References Cited

U.S. PATENT DOCUMENTS

| | | | | |
|---|---|---|---|---|
| 6,439,055 | B1 * | 8/2002 | Maron | G01L 9/06 73/705 |
| 6,598,481 | B1 | 7/2003 | Schultz | |
| 8,912,852 | B2 * | 12/2014 | Godager | E21B 47/06 331/176 |
| 2002/0026835 | A1 | 3/2002 | Jacob et al. | |
| 2003/0164037 | A1 * | 9/2003 | Moffatt | E21B 43/11 73/152.46 |
| 2008/0308271 | A1 | 12/2008 | Chouzenoux et al. | |
| 2012/0024050 | A1 | 2/2012 | Godager | |
| 2012/0198939 | A1 | 8/2012 | Brown et al. | |
| 2012/0306581 | A1 | 12/2012 | Godager | |

OTHER PUBLICATIONS

International Search Report and The Written Opinion of the International Search Authority, or the Declaration, dated Apr. 14, 2016 PCT/IB2016/050091, 17 pages, ISA/EP.

Park, et al., "Novel and Permanent Measurement of Formation Pore Pressure," EAGE Workshop on Geomechnics in the Oil & Gas Industry, May 11-14, 2014, Dubai, UAE.

Park, et al., "Novel Apparatus and Methodlogy to Permanently Monitor Formation Pore Pressure in a Wellbore," Fourth EAGE Shale Workshop Shales: What Do They Have in Common, Apr. 6-9, 2014, Porto, Portugal.

* cited by examiner

1

METHOD AND APPARATUS FOR PERMANENT MEASUREMENT OF WELLBORE FORMATION PRESSURE FROM AN IN-SITU CEMENTED LOCATION

BACKGROUND OF THE INVENTION

Field of the Invention

The present invention relates to an in-situ method and system for measuring wellbore pressures in a formation. More specifically, a pressure gauge is arranged to be permanently cemented in place outside of a wellbore conduit, and pressure measurements signals representing the formation pressure are sent to a control unit.

Description of Prior Art

Different technologies can be applied for measurement of the pressure in the formation surrounding the wellbore, but in general some type of a pressure gauge is arranged in the formation, or in contact with the formation.

International patent publication WO2007/056121 A1 discloses a method for monitoring formation pressure, where the gauge is shot from a gun attached to the wellbore conduit through the cement and into the formation.

International publication WO2012073145 A1 discloses a method for measuring pressure in an underground formation by establishing a flowline and a piston to suction fluid into a test chamber.

International publication WO2013052996 discloses a method for installing a pressure transducer in a borehole, where a fluid connection between the transducer and the sensor is established through the cement.

U.S. Pat. No. 5,467,823 shows a method and apparatus of monitoring subsurface formations by means of at least one sensor responsive to a parameter related to fluids, comprising the steps of: lowering the sensor into the well to a depth level corresponding to the reservoir; fixedly positioning the sensor at the depth while isolating the section of the well where the sensor is located from the rest of the well and providing fluid communication between the sensor and the reservoir by perforating the cement.

In general all permanent pressure gauges have a sensor, a fluid fill, and a process isolation system. The sensor is often a quartz crystal resonator sensor. The process isolation system protects the oil around the sensor itself, as this needs to be in an oil filled and inert medium to measure the pressure in the fluid. The isolation system may typically be established by a bellows or using a diaphragm or by one or more relatively large oil volume oil chambers in series separated by a buffer tube system.

US patent application 2012/0198939 A1 describes a housing including a longitudinal bore therein, and a recess in the housing in communication with the bore. A diaphragm is attached to the housing proximate a periphery of the recess and seals the recess and the longitudinal bore from an environment exterior to the housing. The housing comprises a sensor chamber with a sensor in communication with the longitudinal bore.

The negative side of using a diaphragm is that a relatively wide area diaphragm is needed to provide effective and sufficient volume compensation of the oil fill surrounding the sensor. In turn, a larger area diaphragm is vulnerable to damage and overexposure of its dynamic range.

Buffer tubes are coiled pieces of tubing that are attached to the sensor port. The buffer tube serves as a mechanical isolator to prevent shock or vibration from being transmitted directly to the sensor. However, buffer tubes in series with one or more coupled oil chambers is not really an isolation system as oil is in a continuous contact from the outside and inward to the sensor. Another related problem is that the buffer tubes may clog up with time.

U.S. Pat. No. 4,453,401 shows a system for measuring transient pore water pressure in the ground utilizes a probe member with an arrangement of a pressure sensor and a soil stress isolation filter. The probe member has a body portion with a hollow cavity defined therein. The pressure sensor in the form of a ceramic transducer is mounted in the cavity.

The use of bellows are known from prior art. However, in a traditional pressure gauge configuration, the pressure port of the pressure gauge housing is open to the environment. In turn, this exposes the bellows to the fluids of the surroundings without being filtered. This typically lead to deposition of sediments in the chamber housing the bellows, which inhibits it freedom to move with time or in worst case becoming non-functional as an elastic element transferring the pressure from the outside to the inside. The latter is typically the case if the sensor is placed in a location that is being cemented. Cement will fill the housing surrounding the bellows and as it hardens the pressure gauge will be isolated and disabled to see the pressure change on the outside wellbore or formation, as the bellows is no longer able to work as an elastic element.

SUMMARY OF THE INVENTION

A main object of the present invention is to disclose a method and a system for in-situ determination of a wellbore formation pressure without having to establish a fluid connection between the pressure gauge and the formation by perforating the cement according to prior art.

Another objective of the invention is to improve the responsiveness of the measurements of the proposed solution, so that the measured pressure reflects the actual formation pressure in real time.

In an embodiment the invention is an in-situ wellbore formation pressure gauge system for determination of a wellbore formation pressure of a formation fluid through a layer of cement, said pressure gauge system comprising:

a housing arranged to be permanently installed in said cement on the outside of a wellbore casing, wherein said housing comprises:

- a pressure sensor with an output pressure signal;
- a first oil filled chamber;
- a pressure transfer means between said first oil filled chamber and said pressure sensor, arranged to isolate said pressure sensor from said oil filled chamber; and
- a pressure permeable filter port through a wall of said housing, wherein said pressure permeable filter port is in hydrostatic connectivity with said first oil filled chamber, wherein said pressure gauge system further comprises a porous string extending outside said housing from said filter port, wherein said string has a higher porosity and a higher hydrostatic connectivity than said cement for said formation fluid, and wherein said string is arranged to transfer said formation fluid in its longitudinal direction when it is embedded in said cement to allow said formation pressure to act on said pressure transfer means via hydrostatic connectivity in said cement and in said string.

In this way the string will become a porous channel through a portion of the cement when the pressure gauge system is cemented in place. Thus, the gauges surface area, or contact area with the surrounding formation, cement or grout, will be drastically increased with respect to prior art. Since the pressure detection is based on hydrostatic connectivity through the formation and the cement which inherently is a slow process, the size of the contact area has a large impact on the responsiveness and the accuracy of the measurements. The cement will also have a further important function according to the invention in addition to allowing hydrostatic connectivity from the formation into the string. When the grout hardens, the cement becomes a delimiter, or shield for the oil inside the string. This has the effect that the string behaves like a tube or guide with a much faster pressure transfer response than the surrounding cement, and changes picked up by the large contact area of the string can be effectively transmitted to the housing through the much smaller cross section of the string.

In an embodiment the string comprises absorbed oil with capillary and surface tension effects stronger than the cement or a grout of the cement. This has the additional advantage that the string can be pre-tensioned, and the string will experience very little compression when embedded in the grout. This will again ensure that a maximum contact area is obtained with the surroundings.

In an embodiment the wellbore formation pressure gauge system the string is arranged about a circumference of the casing. This has the advantage that the contact area is distributed around the casing in a specific level, and pressure fluctuations from all directions are captured by the pressure sensing interface at this same level.

BRIEF DESCRIPTION OF THE DRAWINGS

The attached figures illustrate some embodiments of the claimed invention.

DETAILED DESCRIPTION

The invention will in the following be described and embodiments of the invention will be explained with reference to the accompanying drawings.

Figure 1:
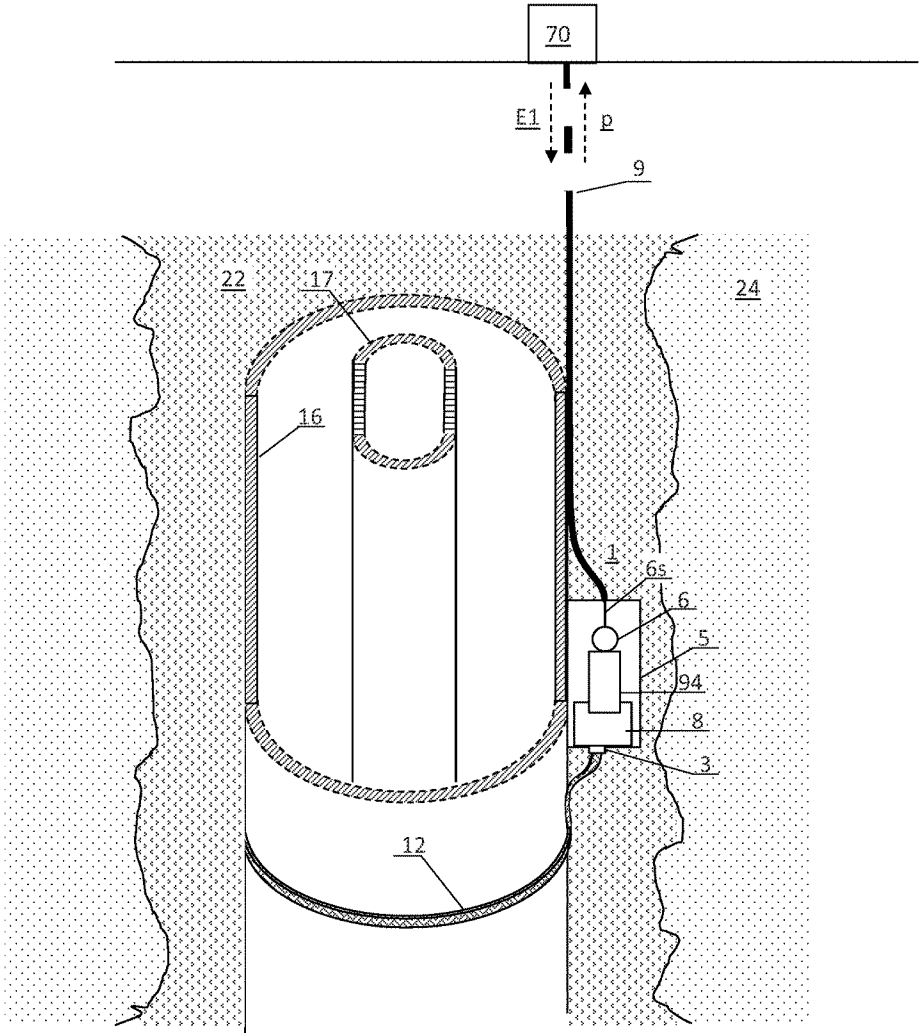
FIG. 1 is a simplified combined section view and block diagram of a wellbore installation with a pressure gauge system according to an embodiment of the invention.

FIG. 1 is a simplified combined section view and block diagram of an in-situ wellbore formation pressure gauge system (1) for determination of a wellbore formation pressure of a formation fluid in the formation (24) through a layer of cement (22) between a wellbore casing (16) and the formation. In addition to the casing, a tubing or a liner (17) running inside the casing is also shown.

The pressure gauge system (1) comprises a housing (5) that is arranged to be permanently installed in the cement (22) on the outside of the wellbore casing (16). The housing (5) will therefore be at least partly surrounded by cement after cementing of the annulus outside the casing (16). The housing (5) comprises the pressure sensor (6) with an output pressure signal (6*s*) which is intended to be an output signal of the housing (5), or it may be further processed by processing means inside the housing before being transmitted to a control unit (70) above sea surface, as will be described below. The housing (5) further comprises a first oil filled chamber (8) and pressure transfer means (94) between the first oil filled chamber (8) and the pressure sensor (6), arranged to isolate said pressure sensor (6) from said oil filled chamber (8), and a pressure permeable filter port (3) through a wall of the housing (5), wherein the pressure permeable filter port (3) is in hydrostatic connectivity with the first oil filled chamber (8). The pressure transfer means (94) will isolate the pressure sensor (6) from the surroundings, ensuring that contamination and fragments reaching the housing (5) do not preclude the operation of the pressure sensor (6). The pressure gauge system (1) further comprises a porous string (12) extending outside the housing (5) from the filter port (3), wherein the string (12) has a higher porosity and a higher hydrostatic connectivity than the cement (22) for the formation fluid, and wherein the string (12) is arranged for transferring the formation fluid in its longitudinal direction when it is embedded in the cement (22) to allow the formation pressure to act on the pressure transfer means (94) via hydrostatic connectivity in the cement (22) and in the string (12).

Thus, the porous string (12) extends from the housing (5) before cementing. During cementing the grout will fill the available space in the annulus outside the casing (16). However, since the string (12) takes up some of the space in the annulus, the space taken up by the string (12) will not be filled with grout or cement. When the grout hardens into cement, the space taken up by the string will act like a hydraulic line into the housing (5), transferring fluid pressure into the first oil filled chamber (8) and further to the pressure sensor (6) via the pressure transfer means (94).

In addition, the hydraulic line that has been established has no boundary or shield other than the cement itself. This means that the hydraulic line also will allow hydraulic connectivity with the surrounding cement along the length of the string, and the contact area allowing hydraulic connectivity increases compared to prior art systems, which in turn increases the ability to pick up pressure changes and increases the corresponding responsiveness of the system.

The porous string may be made of natural or synthetic material as long as it has a higher porosity and a higher hydrostatic connectivity than the cement (22) for the formation fluid. In an embodiment the porous string is also arranged to have capillary effects for the formation fluid.

The string may be braided, foamed or manufactured according to known production technologies.

In an embodiment the porous string (12) comprises absorbed oil, e.g. the string may be wetted in a silicone type or similar oil having surface tension effects stronger than a fluidic cement or grout. Thus, the string will become pre-tensioned and formed by the overburden pressure of the surroundings.

Figure 3:
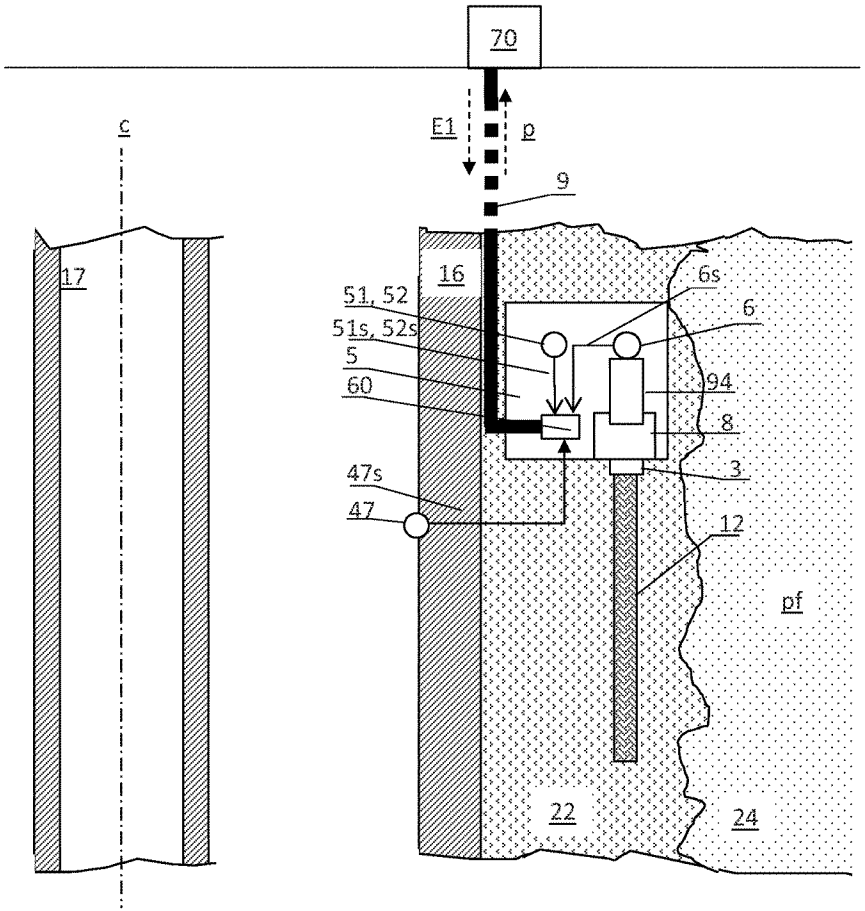
FIG. 3 is a simplified section view of a wellbore installation with a pressure gauge system with compensation illustrated as a block diagram according to an embodiment of the invention.
Figure 4:
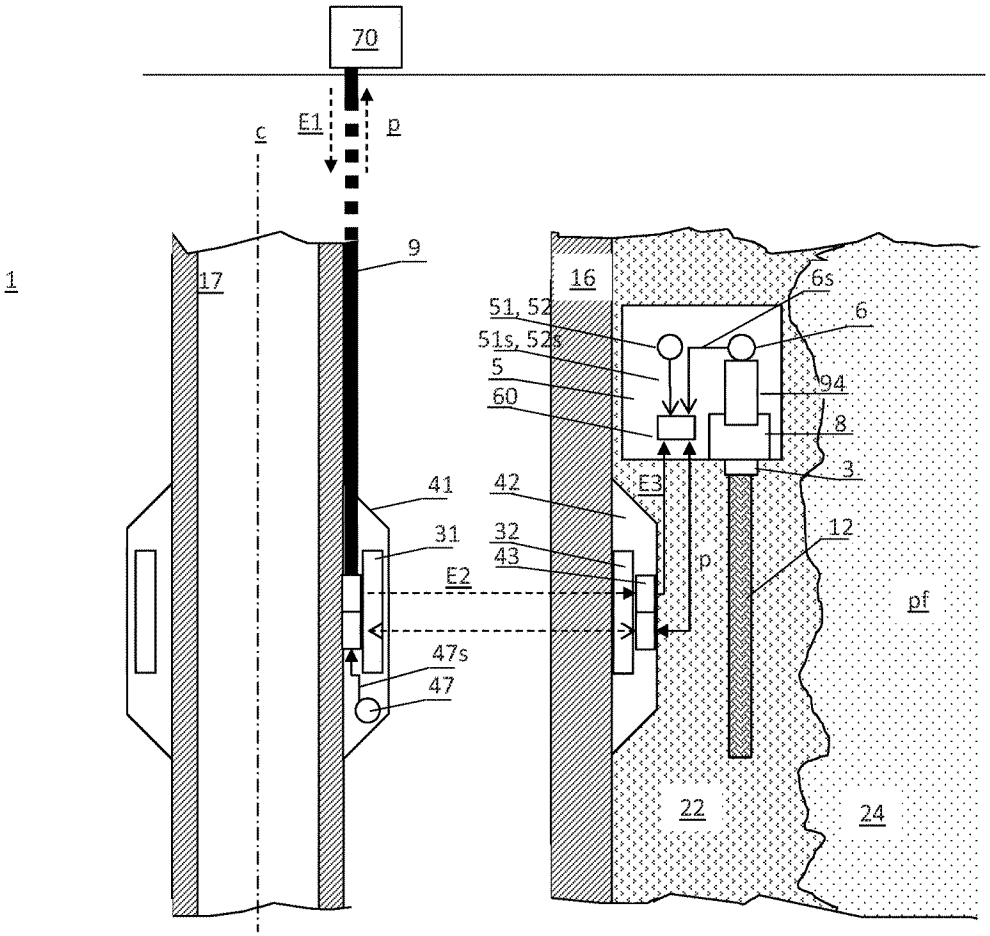
FIG. 4 is a simplified section view of a wellbore installation with a pressure gauge system with compensation comprising wireless transfer means according to an embodiment of the invention.
Figure 5:
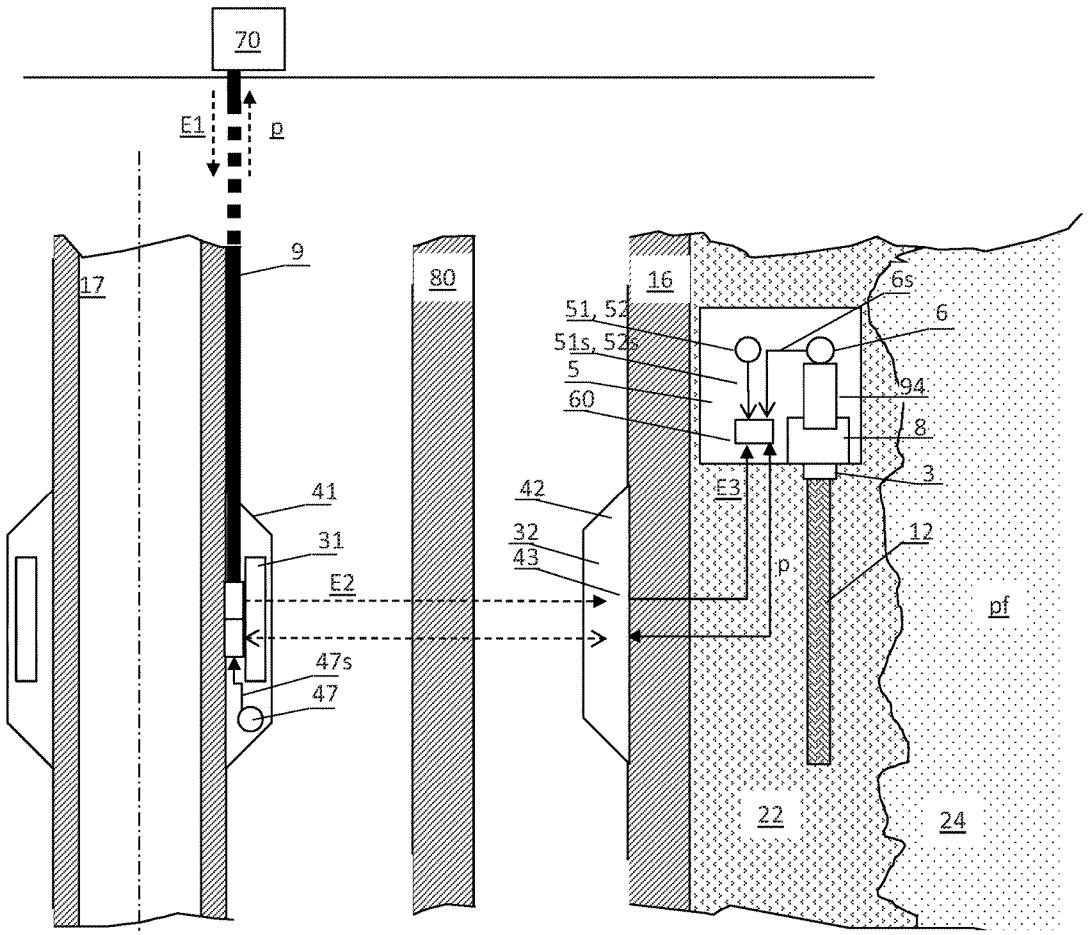
FIG. 5 is a simplified section view of a wellbore installation with a pressure gauge system comprising wireless transfer means across an intermediate casing according to an embodiment of the invention.

In an embodiment the string (12) is pending freely as illustrated in FIGS. 3, 4 and 5 before cementing the well.

Due to the grout sliding down the annulus and becoming attached to the string (12), the string will more or less maintain its vertical extension.

Figure 2:
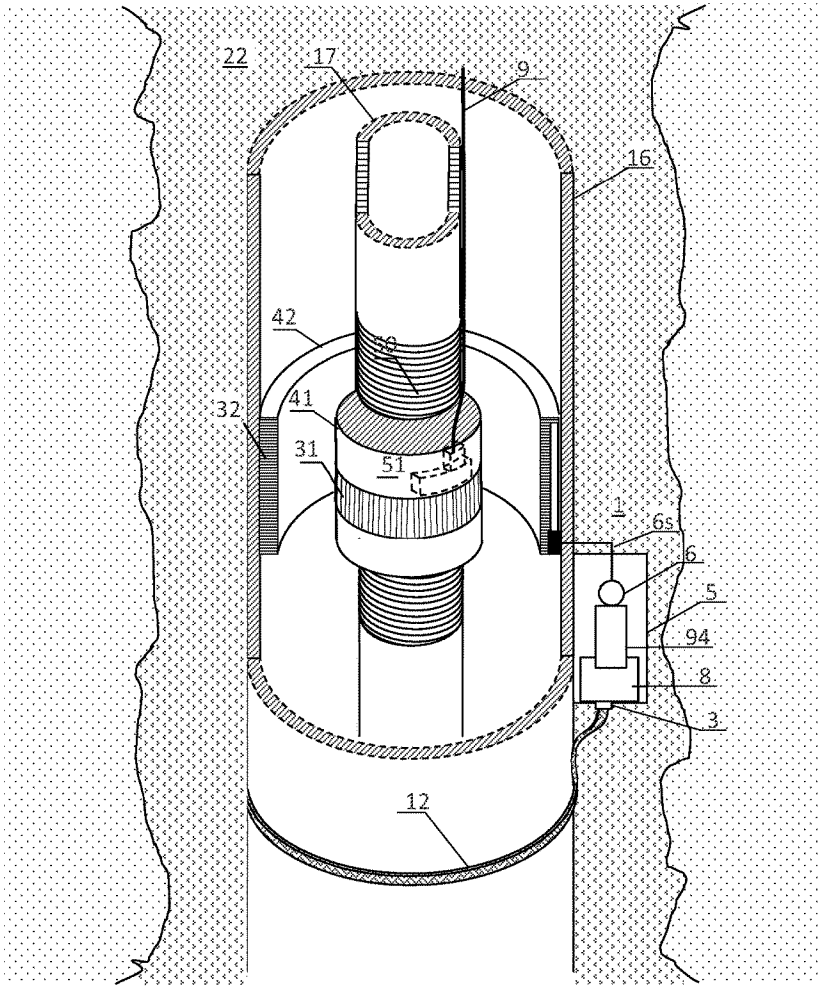
FIG. 2 is a simplified combined section view and block diagram of a wellbore installation with a pressure gauge system and wireless transfer means according to an embodiment of the invention.

In an embodiment the porous string (12) is arranged about a circumference of the casing (16) as illustrated in FIGS. 1 and 2. The contact area of the string is here distributed around the casing at a specific level of the wellbore, and pressure fluctuations from all directions are captured by the pressure sensing interface at this same level. It is often a need to measure the pressure at a specific level, or levels, and several pressure gauge systems (1) may be applied to measure the pressure at multiple levels simultaneously.

In a further embodiment, the casing may have a groove arranged to accommodate the string (12). The string may in this embodiment reside in the groove to avoid damage and wear as the sensor is run into the hole and the annulus is cemented. In an embodiment the groove runs along the circumference of casing (16).

In an alternative embodiment the pressure gauge system (1) comprises a centralizer with bow-springs (not shown) arranged on said casing (16) wherein the string (12) is arranged along one or more of the bow-springs. The bow-springs will therefore arrange the string (12) closer to the formation (24), and in some situations this may be advantageous.

FIG. 3 is a sectional view combined with a block diagram of a wellbore where the pressure gauge system (1) is installed according to an embodiment of the invention.

The dotted, vertical line (c) illustrates the center of the wellbore, and a tubing (17), such as a production tubing, runs through the wellbore. The terms outside and inside used in the document refers to positions relative the vertical center line (c). E.g outside the tubing (17) means outside the casing wall with reference to the center line (c), which is inside the tubing (17).

Outside the tubing (17) there is a casing (16) shown to the right. The left side of the casing (16) is not shown in this sectional view, but it will be understood that the casing surrounds the tubing (17).

Between the casing (16) and the formation (24) there is a layer of cement (22) to stabilize and fasten the casing (16) in the wellbore.

The pressure gauge system (1) for in-situ determination of a wellbore formation pressure through a layer of cement (22), comprises in this embodiment;

a housing (5) arranged to be permanently installed in the cement (22) on the outside of a wellbore casing (16), wherein said housing comprises;

- a pressure sensor (6) with an output pressure signal (6*s*), wherein the pressure gauge system (1) further comprises:
  - a first temperature sensor (51) with a first temperature signal (51*s*) arranged to measure a first temperature outside the wellbore casing (16), and
  - a computer implemented compensation means (60) arranged to receive the pressure signal (6*s*) and the first temperature signal (51*s*), and calculate a temperature compensated output pressure signal (p).

The invention is also in an embodiment a method for in-situ determination of a wellbore formation pressure through a layer of cement (22), wherein the method comprises the following steps:

detecting an output pressure signal (6*s*) from a pressure sensor (6) arranged in a housing (5) permanently installed in the cement (22) on the outside of a wellbore casing (16);

detecting a first temperature signal (51*s*) from a first temperature sensor (51) arranged to measure a first temperature outside the wellbore casing (16); and calculating a temperature compensated output pressure signal (p) in a computer implemented compensation means (60), based on the pressure signal (6*s*) and the first temperature signal (s).

When the housing (5) with the pressure sensor (6) is arranged inside the cement (22), the formation (24) and the fluids of the formation will be in hydraulic conductivity with the pressure sensor (6) through the cement (22), or any other saturated layer of porous matrix media.

Any measurement of the formation pressure will depend on the temperature of the housing (5) in thermal contact with the cement (22) and the surrounding formation (24). An increase in temperature of the cement (22) would therefore result in an increase in pressure that may not reflect the real pressure in the formation (24), since the temperature of the cement (22) may also depend on the temperature of the wellbore and cavity (16).

The formation pressure detected by the pressure sensor (6) will depend on the temperature of the surrounding cement (22). Thus, the detected pressure is partly thermally induced.

The first temperature sensor (51) is used to compensate for pressure variations resulting from local temperature variations.

Knowing that there is an inherent hydraulic conductivity issue in order to measure true formation pressure due to thermally induced pressures within the pressure sensor and boundary cement, an adaptive method is required to filter and compensate such effects. This is done in time domain using knowledge of the physical model of the hydraulic system of the housing (5) of the pressure gauge system (1), some knowledge of the specific cement (22), which can be obtained by analyzing samples, and deriving a transfer function in terms of ambient pressure and temperature measured by the pressure sensor (6) in response to rate of temperature change with time.

A correction can be obtained by applying the transfer function to the output pressure signal (6*s*) to filter and correct it accordingly so that the resulting, or temperature compensated output pressure signal (p) is less affected by thermally induced changes to the pressure felt by the pressure sensor (6).

The temperature compensated output pressure signal (p) will represent a more correct pressure in the formation (24) at any change of operating conditions affecting the pressure gauge system (1) and its relatively closed sensor system in the housing (5).

Figure 8:
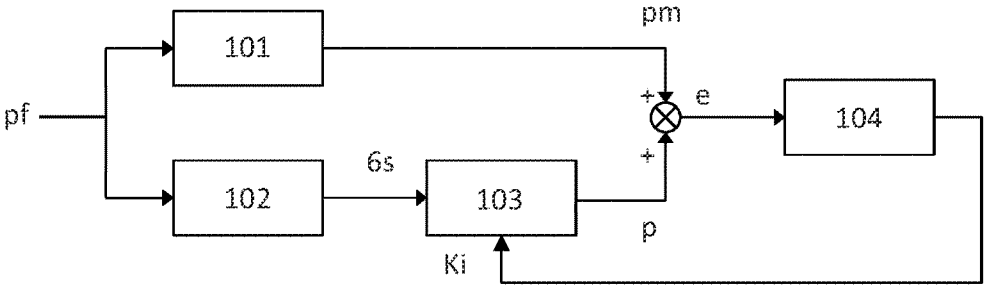
FIG. 8 is a block diagram of adaptive correction of the pressure measurement according to an embodiment of the invention.

An example of the use of transfer function for correction of the pressure measurement according to an embodiment of the invention is illustrated in the block diagram of FIG. 8. This block diagram illustrates an embodiment of the computer implemented compensation means (60).

The real formation pressure (pf) is input to the system transfer model (101) representing the wellbore. This model is developed based on the knowledge of the wellbore characteristics. The output of the transfer function (101) will be a modeled formation pressure (pm).

The other branch represents the real transfer system (102), i.e. the transfer from the real formation pressure (pf) to the sensed pressure (6*s*).

The correction module (103) will calculate the temperature compensated output pressure signal (p). If there is no compensation, the difference (e) will be the difference between the modeled formation pressure (pm) and the sensed pressure (6*s*). The difference (e) will vary with the temperature difference between the formation temperature and the temperature of the pressure sensor (6).

This difference (e) should be as small as possible, and a computing module (104) is arranged to control the values of the correction module (103) to minimize this difference (e).

The optimization parameter (Ki) of the correction module (103) is continuously controlled and set to a value to minimize the difference (e).

According to an embodiment of the invention the pressure gauge system (1) has its own built-in pressure sensor (6) and first temperature sensor (51) element with a frequency output signal like those from crystalline quartz resonators.

According to an embodiment of the invention the pressure gauge system (1) comprises a rate of change temperature sensor (52) with rate of change temperature signal (52*s*) arranged to measure a rate of change of the first temperature outside the wellbore casing (16), wherein the computer implemented compensation means (60) is arranged to receive rate of change temperature signal (52*s*).

The rate of change of the first temperature may in an embodiment be calculated statistically based on the change of the first temperature signal with time, using the first temperature sensor (51).

Thus, in an embodiment the method according to the invention comprises the steps of:

detecting a rate of change of the first temperature in a rate of change temperature sensor (52) with a rate of change temperature signal (52*s*); and calculating the temperature compensated output pressure signal (p) in the computer implemented compensation means (60) also based on the rate of change temperature signal (52*s*).

Typically, the calculation of the formation pressure (p) as indicated above, will exhibit a small to medium lag of compensation and effectiveness. This is mainly caused by the properties and the placement of the first temperature sensor (51) inside the cement (22). Moreover, the gross offsets due to the change in temperature may be corrected, but the fact that a change actually must have taken place in order to be measured, will significantly slow down the speed and response to correct the formation pressure (p). Due to the relatively slow response, the formation pressure (p) will usually be offset with regard to the true formation pressure as long as the temperature is changing, since the correction only takes place when there is an offset as a result of some change in a wellbore parameter.

To further improve the correctness of the pressure measurements a second temperature sensor (47) is used in an embodiment of the invention. Please see FIG. 3. The second temperature sensor (47) is arranged to sense a second temperature inside the wellbore casing (16), and use the second temperature, in addition to the first temperature, as an input to an alternative correction model, called the feed-forward correction model.

This improves the response and almost eliminates the phase lag and resulting offsets that was described above for the adaptive correction model.

In general the source of temperature disturbance or changes in a well is related to changes in load/process conditions occurring coaxially in the center core or conduit of the well, e.g. in the tubing (17) and/or in the annulus outside the tubing (17). Thus a change in load in the center of the well radially influences the temperature of the surrounding casing (16), cement (22) and formation (24). Depending on the temperature of the core relative the surrounding temperature, the energy will be transported either into, or out of the well by the flow of the process medium.

Thus, looking at FIG. 3, it may be seen that by placing a second temperature sensor (47) closer to the production tubing (17) or conduit in the well this sensor will pick up a change in the temperature due to changes in medium flow, composition or load much faster than the first temperature sensor (51) grouted in the cement (22) at the exterior of the wellbore casing (16). Consequently, when a change in the second temperature is detected, we may predict that there will be a change to come in the coaxial radii of the well, i.e. outside the casing (16) and in the cement (22) where the pressure sensor (6) is located.

According to an embodiment, the second temperature signal (47*s*) from the second temperature sensor (47) of the pressure gauge system (1) will be used for correction of the output pressure signal (6*s*) from the pressure sensor (6).

The second temperature sensor (47) is arranged to measure a second temperature inside the wellbore casing (16), wherein the computer implemented compensation means (60) is arranged to receive the second temperature signal (47*s*), and calculate the temperature compensated output pressure signal (p) based on the pressure signal (6*s*), the first temperature signal (51*s*) and the second temperature signal (47*s*).

The corresponding method comprises the steps of:

detecting a second temperature signal (47*s*) from a second temperature sensor (47) arranged to detect a second temperature inside the wellbore casing (16); and calculating the temperature compensated output pressure signal (p) in the computer implemented compensation means (60) based on the pressure signal (6*s*), the first temperature signal (51*s*) and the second temperature signal (47*s*).

In an embodiment the computer implemented compensation means (60) is arranged inside the housing (5) outside the casing (16), and the solution may be referred to as an adaptive feed-forward correction model, since information about changes in the conditions related to the process taking place in the center of the wellbore is dynamically relayed to the remote housing (5) before the change has progressed to the outer radii and the remote housing (5). Due to wellbore geometry and configurations, a well temperature profile from center and outwards, will be mostly affected by the conduit and intermediate fluid masses as temperature in the flowing conduit change. Consequently, the most dominating parameter that control the rate of temperature change, are those related to masses involved as the masses will exhibit thermal inertia.

Thus, using the second temperature sensor (47) inside the well sensing the process where the changes take place and feeding information of a change in progress to a more remote pressure sensor (6) and correction means, such as the computer implemented compensation means (60) will be valuable feed-forward information to the latter for noise removal.

As the pressure gauge system (1) has an encapsulated volume of oil as previously described, a thermally induced pressure will be generated and the output pressure signal (6*s*) will change consequently. Knowing the properties of at least the dead volume of the oil encapsulated in the first oil filled chamber (8) and physical properties of the boundary cement (22), the resulting thermally induced pressure may be corrected ahead of a change by the adaptive feed-forward correction model, removing any apparent "false" thermally induced pressure.

Based on the above description of continuous control of the parameter Ki, the feed forward correction system will now be explained.

Figure 9:
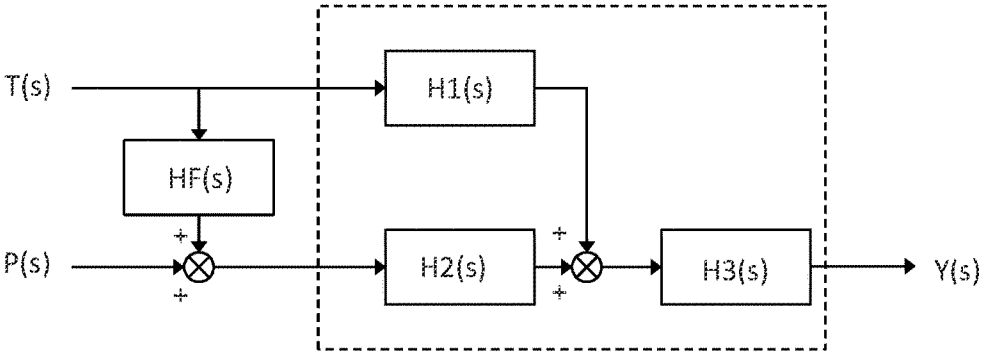
FIG. 9 is a block diagram of feed forward correction of the pressure measurement according to the invention.

Feed-forward correction technique is a good approach to eliminate and remove the influence of noise on a measurement parameter, e.g. pressure, and will increase the response of the pressure gauge system (1) in projecting the correct formation pressure (pf) outside the cement (22). In FIG. 9 it is illustrated in a block diagram how the feed-forward correction technique may be applied to remove thermally induced pressures, i.e. noise, and thereby enhancing the measurements of the real formation pressure. The model is a Laplace transform of the time domain into the frequency domain, where the parameter s is a complex number as will be understood by a person skilled in the art. In the figure, the following blocks are illustrated; La Place transformed thermally induced pressure (H1(*s*)), Hydraulic diffusivity (H2(*s*)), Sensor resonator (H3(*s*)) and Feed forward correction (HF(s)). T(s), P(s) and Y(S) are the Laplace transformed temperature, pressure and output, respectively. The stapled line illustrates the pressure gauge system (1).

If the effect of the noise should be fully removed the following expression is valid:

$$Y(s)=H_1\cdot H_3\cdot \mathrm{Temp}(s)+H_F\cdot H_2\cdot H_3\cdot \mathrm{Temp}(s)=0 \tag{1.1}$$

This gives us $$H_F(s)=-\frac{H_1(s)}{H_2(s)} \tag{1.2}$$

A system realized according to equation 1.2 would be an optimal correction model or solution. To accomplish this, we should comply with the following theorems:

The noise must be measurable;

The sensor resonator model (HF(s)) should include the transfer function of the sensing element;

We need to know the transfer function of the thermally induced pressure (H1(*s*)) and hydraulic diffusivity (H2(*s*)); and The sensor resonator model (HF(s)) must be realizable.

If we set s=0 in equation 1.2, we achieve the static feed-forward condition:

$$H_F(0)=-\frac{H_1(0)}{H_2(0)}$$

It should be noted that, even if not all the conditions stated in the second and third bullet points are possible to accomplish in a given wellbore, a significant response improvement may still be achieved.

In FIG. 3 a physical arrangement of the pressure gauge system (1) according to an embodiment of the invention is shown.

The pressure gauge system (1) comprises:

a first end of a cable (9) connected to the computer implemented compensation means (60), wherein the cable (9) is arranged for transferring electric power (E1) to the computer implemented compensation means (60); and a second end of the cable (9) connected to a control unit (70) arranged to receive the output pressure signal (p) from the computer implemented compensation means (60). The second temperature sensor (47) can be seen arranged on the inside of the casing (16) in communication with the computer implemented compensation means (60).

In the arrangement described above, the cable runs along the outside of the casing (16) up to a control unit (70). There are certain problems related to the installation of a cable (9) outside the casing (16), the arrangement and maintenance of the second temperature sensor (47) inside the casing wall, and the termination of the cable (9) in the control unit (70) on top of the outer casing (16).

An improved arrangement according to an embodiment of the invention is shown in FIG. 2 and FIG. 4, where the cable run along the tubing (17) and inductive transfer is used for both power supply and signal communication between the housing (5) and the control unit (70). In addition the second temperature signal (47*s*) from the second temperature sensor (47) is also sent over the wireless interface from the tubing (16) to the casing (16). Thus the second temperature sensor (47*s*) can be arranged closer to where the temperature changes occur.

In this embodiment the pressure gauge system (1) comprises:

an outer wellbore instrument (42) comprising an outer inductive coupler (32), wherein the outer wellbore instrument (42) is fixed arranged to the wellbore casing (16), an inner wellbore instrument (41) comprising an inner inductive coupler (31) arranged on the outside of a tubing (17) arranged inside the wellbore casing (16);

a first end of a cable (9) connected to the inner wellbore instrument (41), wherein the cable (9) being arranged for transferring electric power (E1) to the inner wellbore instrument (41), and the inner wellbore instrument (41) is arranged to provide inductive power (E2) to the outer wellbore instrument (42), wherein the outer wellbore instrument (42) comprises power means (43) for power harvesting the inductive power (E2) and for providing power (E3) to the computer implemented compensation means (60); and a second end of the cable (9) connected to a control unit (70) arranged to receive the output pressure signal (p) from the computer implemented compensation means (60) via the outer wellbore instrument (42) and the inner wellbore instrument (41).

The corresponding method comprises the steps of:

providing power (E3) to the computer implemented compensation means (60), via a cable (9), an inner wellbore instrument (41), and an outer wellbore instrument (42); and receiving the output pressure signal (p) from the computer implemented compensation means (60) via the outer wellbore instrument (42), the inner wellbore instrument (41) and the cable (9), wherein a second end of the cable is connected to a control unit (70).

The wellbore instrument (42) may be arranged inside the casing (16). However, this means that the casing (16) must be penetrated by power and communication lines to communicate with the components outside the casing (16). The wellbore instrument (42) would also make completion more difficult when it is arranged on the inside of the wall. It may also be entirely or partly arranged within the casing wall, i.e. in a cavity of the wall. However, a more advantageous solution is to arrange the wellbore instrument (42) outside the casing (16). In this embodiment the wellbore casing (16) has a relative magnetic permeability less than 1.05 in a region between the inner wellbore instrument (41) and the outer wellbore instrument (42).

The invention may also be applied where there is more than one annulus between the second temperature sensor (47) and the housing (5) as illustrated in FIG. 5, showing an intermediate casing (80) between the tubing (17) and the casing (16). This may be e.g. a barrier that should not be broken.

In this embodiment the pressure gauge system (1) comprises an intermediate casing section (80) coaxially arranged between the wellbore casing (16) and the tubing (17), wherein the intermediate casing section (80) has a relative magnetic permeability less than 1.05. The outer wellbore instrument (42) should in this embodiment preferably be arranged inside the casing (16) or partly or completely in a cavity of the inner wall of the casing (16) to reduce signal attenuation through solid walls.

In an embodiment the second temperature sensor (42) is arranged inside the tubing (17). This could be performed by an additional inductive coupler inside the tubing (17), and a relative magnetic permeability of less than 1.05 in a region of the tubing (17) between the additional inductive coupler and the inner wellbore instrument (41).

Alternatively, the tubing wall could be to allow a physical connection.

Figure 6:
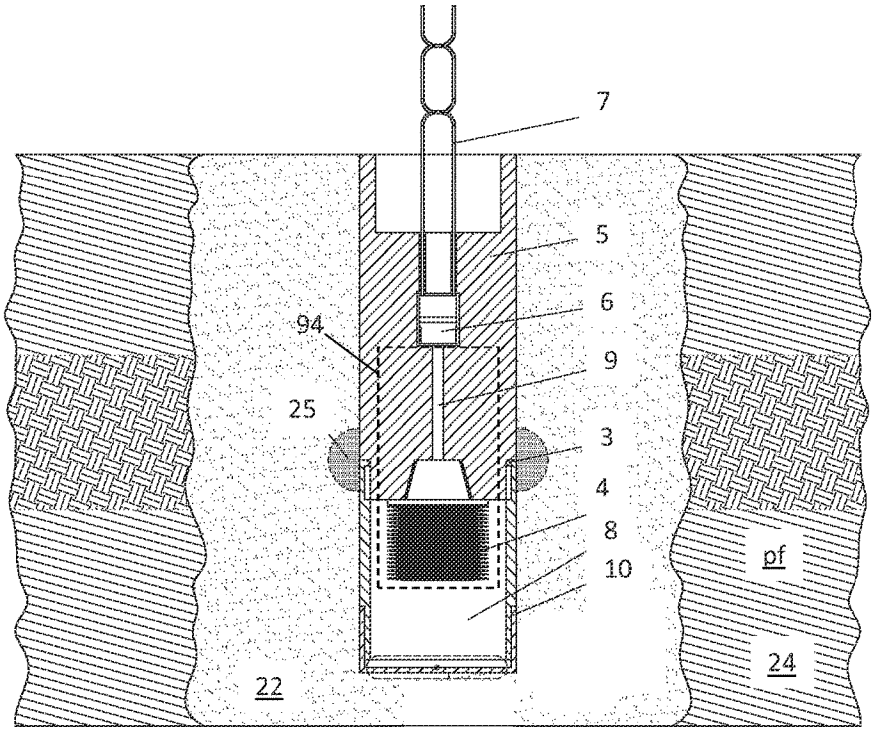
FIGS. 6 and 7 illustrates a housing of the pressure gauge system.
Figure 7:
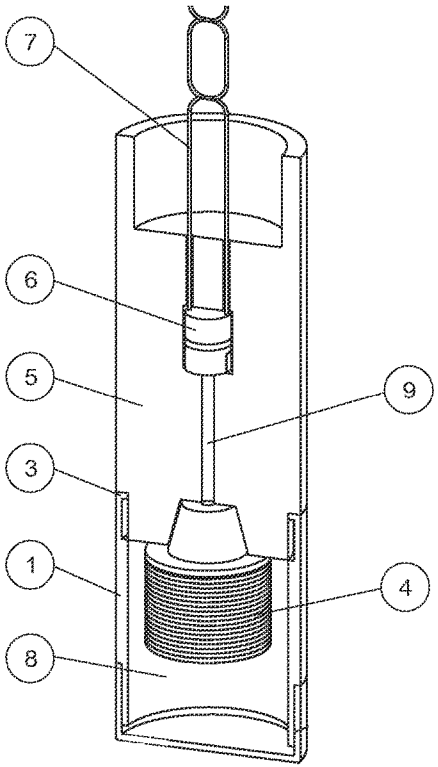

In order to take advantage of the hydraulic conductivity through a saturated layer of porous matrix media like cement (22), certain features of the pressure gauge system (1) according to the invention are advantageous for long term stable measurements, please see FIGS. 6 and 7 showing details of the housing (5).

According to an invention the housing (5) comprises:

a first oil filled chamber (8), a pressure transfer means (94) between the first oil filled chamber (8) and the pressure sensor (6), arranged to isolate the pressure sensor (6) from the oil filled chamber (8); and a pressure permeable filter port (3) through the housing (5) to allow formation pressure from outside the housing (5) to act on the first oil filled chamber (8).

Thus, the pressure inside the first oil filled chamber (8) will be the same as the pressure outside the housing (5) since a pressure connection has been established through the filter port (3), and formation pressure (pf) will be transferred into the first filled oil chamber (8) by hydraulic connectivity through the layer of cement (22), via the filter port (3). In this way the internal fluid inside the housing (5) will be hydraulically balanced with the wellbore formation (24).

The pressure transfer means (94) transfers the pressure of the first filled oil chamber (8) to the pressure sensor (6). In an embodiment the pressure transfer means (94) comprises a second oil filled chamber (9) partly constituted by a second side or interior part of a non-permeable bellows (4), where a first side, or an outer part of the bellows is arranged to reside in the first oil filled chamber (8), and an oil in the second oil filled chamber (9) is in fluid contact with the pressure sensor (6).

In this embodiment the pressure sensor (6) is in fluid contact with the fluid in the second oil filled chamber (9), and detects pressure changes in the second oil filled chamber (9).

The non-permeable bellows (4) isolates the pressure sensor (6). Its purpose is to avoid contamination of second oil filled chamber (9) inside the housing (5) from being mixed with fluids from the surrounding formation (24).

The permeable filter port (3) is the hydraulic gateway connecting first oil filled chamber (8) to the surrounding formation (24) and automatically equalizes any pressure difference between sensor filter port (3) and the exterior formation pressure (24).

In an embodiment the filter port (3) is one or more slits through the housing (5).

The filter port (3) is preferably filled with pressure permeable material saturated by a buffer fluid, typically a filling of viscous oil, which provides an excellent pressure transfer fluid to the port surroundings (25).

Moreover, an additional feature of the filter port (3) when the pressure permeable material is wet and saturated by the oil fill from the first oil filled chamber (8), is that it in turn avoids clogging as it prevents the wellbore grouting cement to bind to the pressure permeable material. In an embodiment the pressure permeable material extends from the filter port (3) outside the housing (5), and increases the filter volume. This feature grants the hydraulic connectivity of the sensor to its surroundings.

In an embodiment the pressure permeable material is hemp fiber, and the slit of the filter port (3) is filled with the hemp fiber.

In an alternative embodiment the pressure permeable material consists of a number of pressure permeable capillary tubes extending radially outwards from the slit.

FIGS. 6 and 7 also illustrates the connection line (7) of the pressure sensor (6).

The features above related to the internals of the housing (5) may be combined with any of the previous mentioned embodiments related to features for correction of the pressure signal (p) and communication based on wireless transfer of power and pressure and temperature signals.

In an embodiment the wellbore formation pressure gauge system (1) may be configured as a tool, comprising, in addition to any of the embodiments described above, a section of the casing (16) and/or a section of the tubing or liner (17).

The invention claimed is:

1. An in-situ system for determination of a pressure of a formation fluid through a layer of cement in a wellbore, the system comprising:

a housing disposed in the cement and outside a wellbore casing;

a pressure sensor disposed in the housing;

a first oil filled chamber disposed in the housing;

a second oil filled chamber disposed between the first oil filled chamber and the pressure sensor;

a pressure permeable filter port through a wall of the housing; and a porous string extending from the filter port and into the cement, the porous string being disposed substantially circumferentially about the wellbore casing and in hydrostatic connectivity with the formation fluid in the cement.

2. The system of claim 1, wherein the filter port is in hydrostatic connectivity with the first oil filled chamber, and the string is in fluid communication with the formation fluid.

3. The system of claim 2, wherein the string includes absorbed oil.

4. The system of claim 3, further comprising:

a centralizer with bow springs, wherein the string is disposed along one of the bow springs;

a first temperature sensor disposed in the housing and in thermal communication with the cement and wellbore;

a second temperature sensor disposed inside the wellbore casing; and a rate of change temperature sensor.

5. The system of claim 4, further comprising a computer disposed in the housing and in communication with the pressure sensor and the temperature sensors.

6. The system of claim 5, further comprising:

a wireless interface having an inner wellbore instrument disposed outside a tubing and inside the wellbore casing and an outer wellbore instrument disposed outside the wellbore casing; and a cable disposed along the tubing inside the wellbore and in communication with the inner wellbore instrument and the control unit.

7. The system of claim 6, wherein the wellbore casing has a relative magnetic permeability less than 1.05 in a region between the inner wellbore instrument and the outer wellbore instrument.

8. The system of claim 7, further comprising an intermediate casing disposed between the wellbore casing and a tubing, and having a relative magnetic permeability less than 1.05.

9. The system of claim 8, further comprising a non-permeable bellows disposed at least partly in the first oil filled cavity and in fluid communication with the second oil filled chamber and the pressure sensor.

10. The system of claim 9, wherein the first oil filled chamber is in fluid communication with the formation fluid.

11. The system of claim 10, wherein oil in the second oil filled chamber is in fluid communication with the pressure sensor.

12. The system of claim 1, wherein the pressure permeable filter port is filled with pressure permeable material saturated by a buffer fluid.

* * * * *